US005237793A

United States Patent [19]

Puder

[11] Patent Number: 5,237,793

[45] **Date of Patent: * Aug. 24, 1993**

[54] ELONGATED PRESTRESSED CONCRETE TANK AND METHOD OF CONSTRUCTING SAME

[75] Inventor: Hugh E. Puder, Gainesville, Fla.

[73] Assignee: The Crom Corporation, Gainesville, Fla.

[ * ] Notice: The portion of the term of this patent subsequent to Jul. 4, 2006 has been disclaimed.

[21] Appl. No.: 869,878

[22] Filed: Apr. 17, 1992

Related U.S. Application Data

[63] Continuation of Ser. No. 343,611, Apr. 27, 1989, abandoned, which is a continuation of Ser. No. 220,435, Jul. 13, 1988, Pat. No. 4,843,778, which is a continuation of Ser. No. 44,682, May 1, 1987, abandoned.

[51] Int. Cl.[5] ..... E04B 1/16; E04G 21/02

[52] U.S. Cl. ..... 52/745.01; 52/741.1; 264/34

[58] Field of Search ..... 52/741.1, 745.01, 169.7, 52/223.3, 245; 264/31, 34

[56] References Cited

U.S. PATENT DOCUMENTS

| | | | |
|---|---|---|---|
| 2,315,894 | 4/1943 | Crom | 52/741 |
| 3,385,016 | 5/1968 | Crom | 52/224 |
| 3,869,530 | 3/1975 | Williams | 52/741 |
| 4,070,836 | 1/1978 | James et al. | 52/245 |
| 4,402,753 | 9/1983 | Amara et al. | 106/94 |

*Primary Examiner*—Michael Safavi
*Attorney, Agent, or Firm*—Staas & Halsey

[57] ABSTRACT

A prestressed concrete tank includes a pair of generally parallel, laterally spaced, straight concrete wall sections which are preshrunk by the application of compressive forces. Straight wall sections are constructed on top of a footing covered with a plurality of plastic sheets to reduce friction so that limited longitudinal movements of at least portions of each wall section are facilitated during the preshrinking operation. The ends of the tank comprise semicircular walls which are prestressed using wire tendons extending peripherally around the wall and tightened to impose centripetal forces on the wall and thereby place the same into circumferential compression. The walls each comprise a substantially vertical steel shell diaphragm with a layer of cementitious material such as shotcrete on each side thereof. The steel diaphragm comprises a plurality of panels having vertical edges which cooperate to form joints, a shotcrete cover is shot over both faces of the diaphragm, and a sealing material is pumped into the joints after application of the shotcrete to substantially fill voids and other hollow places within the layers of cementitious material.

10 Claims, 9 Drawing Sheets

ELONGATED PRESTRESSED CONCRETE TANK AND METHOD OF CONSTRUCTING SAME

This is a continuation of U.S. Ser. No. 07/343,611 filed Apr. 27, 1989 now abandoned which is a continuation of U.S. Ser. No. 07/220,435 filed Jul. 13, 1988 now U.S. Pat. No. 4,843,778, which is a continuation of U.S. Ser. No. 07/044,682, filed May 1, 1987, now abandoned.

BACKGROUND ON THE INVENTION

1. Field of the Invention

The present invention relates to improved prestressed concrete tanks and their construction and, more particularly, relates to elongated prestressed concrete tanks which may be designed and adapted for more efficient utilization of the area of construction site.

2. Description of the Prior Art

The present invention is particularly useful in connection with prestressed composite tanks. Such tanks are widely used for storage of liquid and similar purposes and normally include a light gauge steel shell diaphragm which is encased in layers of a cementitious material such as shotcrete While these tanks have become known as prestressed concrete tanks, the term concrete is used generically and in practice includes shotcrete (which may contains small rocks). The shotcrete utilized in the construction of prestressed composite tanks is generally applied by a pressure gun and thus rocks of any substantial size cannot be tolerated. The cementitious material that is utilized in connection with the present invention, generally consists of a mixture of cement, sand and water, although small rocks might be incorporated into the mixture so long as the same are small enough to flow through the nozzle of the gun.

The prestressed composite tanks which are known have generally been of circular construction. Thus, after the steel shell is encased in layers of a cementitious material, the outer periphery may be wrapped with prestressing wire which, after tightening, is enclosed by a cover coating of shotcrete. Stretching or tightening of the wire imposes centripetal forces on the wall of the tank and thus, due to the circular configuration of the wall, the entire wall is placed into circumferential compression. Such prestressed tanks and a method for producing the same are disclosed in U.S. Pat. No. 3,822,520 which is owned by the assignee of the present application.

The '520 patent also discloses a method for sealing the joints between adjacent panels of the steel shell. This method involves forming joints so that they provide a hollow channel which runs vertically of the joint, and thereafter pumping the channel full of a sealant. This method for sealing panels is utilized in the preferred tanks and construction methods of the present invention and the entirety of the disclosure of the '520 patent is hereby specifically incorporated by reference.

As set forth above, prestressed composite tanks have traditionally been circular so that prestressing is accomplished simply by pulling a prestressing wire all the way around the tank to thereby place the entire circumferential extent of the wall into circumferential compression. Moreover, it has been known to wrap a single wire spirally around the tank so that a significant vertical portion of the tank may be prestressed with a single wire. Such methods are well known and have been utilized for a long period of time and such prestressing methodology is fully disclosed and described in U.S. Pat. No. 2,370,780, the entirety of the disclosure of which is also hereby incorporated by reference.

The fact that known prestressed composite tanks are circular has been a problem in the industry on construction sites that are not of a size and shape to efficiently facilitate and accommodate circular tanks, particularly when large gallonages are required. That is to say, long and narrow sites may not accommodate the construction of a circular tank of the required size. Accordingly, the use of elongated tanks which might more efficiently be fitted into the construction site have been suggested. However, elongated tanks by necessity include elongated straight wall sections, which until the present invention, were subject to cracking from shrinkage during curing and hardening of the cementitious material.

SUMMARY OF THE INVENTION

The problem of uncontrolled shrinking and resultant cracking during curing and hardening of elongated straight wall sections constructed of cementitious material has been solved through the use of the present invention which provides, in an elongated, prestressed tank, a straight, preshrunk, substantially crackless, elongated, wall section; means for exerting end-to-end preshrinking compressive forces on the straight wall section; a generally semicircular, prestressed end wall having a pair of circumferentially spaced extremities, one of the extremities of the end wall being disposed in generally abutting relationship with respect to one end of the straight wall section; and means exerting circumferentially directed compressive prestressing forces on said end wall.

The straight walls are preshrunk as a result of application of the principles and concepts of the present invention. As is usual in shotcrete type construction, the walls are kept moist and under conditions which retard shrinkage until high strength is achieved. The walls are kept moist by playing the same with streams of water. After curing has proceeded to a point where the high strength is achieved, the streams of water are discontinued and the wall is placed into end-to-end compression. The compressed wall is permitted to shrink or contract or shorten while the compressive forces are maintained on the ends thereof. After the process of shrinking under compression has proceeded for a sufficient period of time, a straight, elongated, preshrunk, substantially crackless wall is produced.

In a more specific aspect, the invention provides means for exerting end-to-end compressive forces upon the straight wall section which comprises a plurality of tensioned, threaded rods extending longitudinally through the straight wall section and nut means threadably engaged on each rod and operable for bearing against an end of the straight wall section. The invention also provides means for exerting circumferentially directed compressive forces on the end wall which comprises a plurality of wire tendons stretched peripherally around the end wall in a position to exert centripetal forces on the wall. In this regard the centripetal (radially inwardly directed) forces acting in conjunction with the circular shape of the wall create circumferentially directed compressive forces in the wall.

In a particularly preferred form, the invention provides a keystone joint construction at the juncture point between the straight walls and the curved end walls which comprises a plate secured against one end of the straight wall by the nuts on the threaded rod, clamp means attached to the plate for securing the ends of the tendons utilized for compressing the semicircular end walls and a generally trapezoidally shaped block of cementitious material. The keystone joint is configured and arranged for transfer of forces between a straight wall section and a semicircular end wall.

To facilitate preshrinking of the straight wall section, the structure includes friction reducing means disposed beneath the straight wall section and permitting at least slight longitudinal movement of at least portions of the straight wall to facilitate preshrinking of the latter without substantial cracking. In a particularly preferred form of the invention, the means beneath the wall section comprises a plurality of plastic sheets disposed to minimize friction between the base of the wall section and its footing.

In its most efficient form, the invention provides means for exerting sufficient compressive pressure on the ends of the straight wall section during hardening thereof to preshrink the wall without substantial cracking, in combination with means disposed beneath the wall section comprising a plurality of plastic sheets which minimize friction at the base of the wall section and facilitate at least slight longitudinal movement of at least portions of the straight wall so that the wall may contract during the preshrinking operation as a unitary object and without substantial cracking.

The invention also provides an elongated, prestressed concrete tank comprising at least a pair of elongated, generally parallel, laterally spaced, preshrunk, substantially crackless, straight wall sections; means for exerting end-to-end compressive forces on the straight wall sections; at least a pair of prestressed end walls with each end wall interconnecting corresponding ends of the straight wall sections; and means exerting compressive prestressing forces on each of the end walls. More particularly, the invention provides a tank wherein at least one of the end walls is semicircular and spans the distance between the ends of the straight wall sections at one end of the tank. The invention further provides means exerting compressive forces on the semicircular end wall which comprise a plurality of wire tendons stretched peripherally around the end wall in a position to exert centripetal forces on the end wall and thus impose circumferentially directed compressive forces thereon.

In an even more particularized aspect of the invention, a tank is provided which includes a third longitudinally extending straight wall section disposed between the preshrunk wall sections. In this aspect of the invention, one of the end walls of the tank comprises a pair of side-by-side, semicircular wall portions, one of which spans the distance between and interconnects one end of the third wall section and the corresponding end of one of the preshrunk wall sections and the other wall portion spans the distance between and interconnects the same end of the third wall section and the corresponding end of the other preshrunk wall section. In this form of the invention, the means exerting compressive forces on the end walls comprises a respective set of tendons stretched peripherally around each of the semicircular wall portions in a position to exert centripetal forces on each portion and thus impose circumferentially directed compressive forces thereon. The invention further provides a keystone joint element which comprises a plate secured to an end of the third wall section, a respective clamp means for each set of tendons for securing an end of each of the tendons of each set and a generally trapezoidal block of cementitious material, all for the purpose of efficiently transferring forces between the various walls which converge at the keystone.

The invention also provides a method for constructing an elongated, prestressed concrete tank which comprises: forming at least a pair of generally parallel, laterally spaced, elongated, straight wall sections of a cementitious material; subjecting each straight wall section to end-to-end compressive forces and allowing such straight wall sections to preshrink without substantial cracking under the influence of said end-to-end forces during the hardening and shrinking of the cementitious material; forming end walls of cementitious material in abutting relationship to the corresponding ends of the preshrunk wall sections; and prestressing the end walls by applying compressive forces thereto. In accordance with the invention, the method involves the step of subjecting the straight walls to end-to-end compressive forces by providing a plurality of tensioned threaded rods extending longitudinally through the wall section and threading a nut onto each rod and into bearing and force transferring relationship against an end of the wall section. In accordance with the invention, at least one of the end walls is formed in a semicircular shape and the step of prestressing the same comprises stretching a plurality of tendons peripherally therearound in a position for exerting centripetal forces thereon. In accordance with the method of the invention, the step of allowing the straight wall section to preshrink preferably includes constructing the wall on a friction reducing surface permitting at least slight longitudinal movement of at least portions of the wall section relative to its footing. In this regard, in its particularly preferred form, the invention provides for the wall to be constructed atop a plurality of plastic sheets to minimize friction at the base of the wall section between the wall and its footing during the preshrinking of the wall section so that the wall section may shrink as a single unitary body and thus preclude substantial cracking during the preshrinking operation.

DESCRIPTION OF THE PREFERRED EMBODIMENTS

Figure 1:
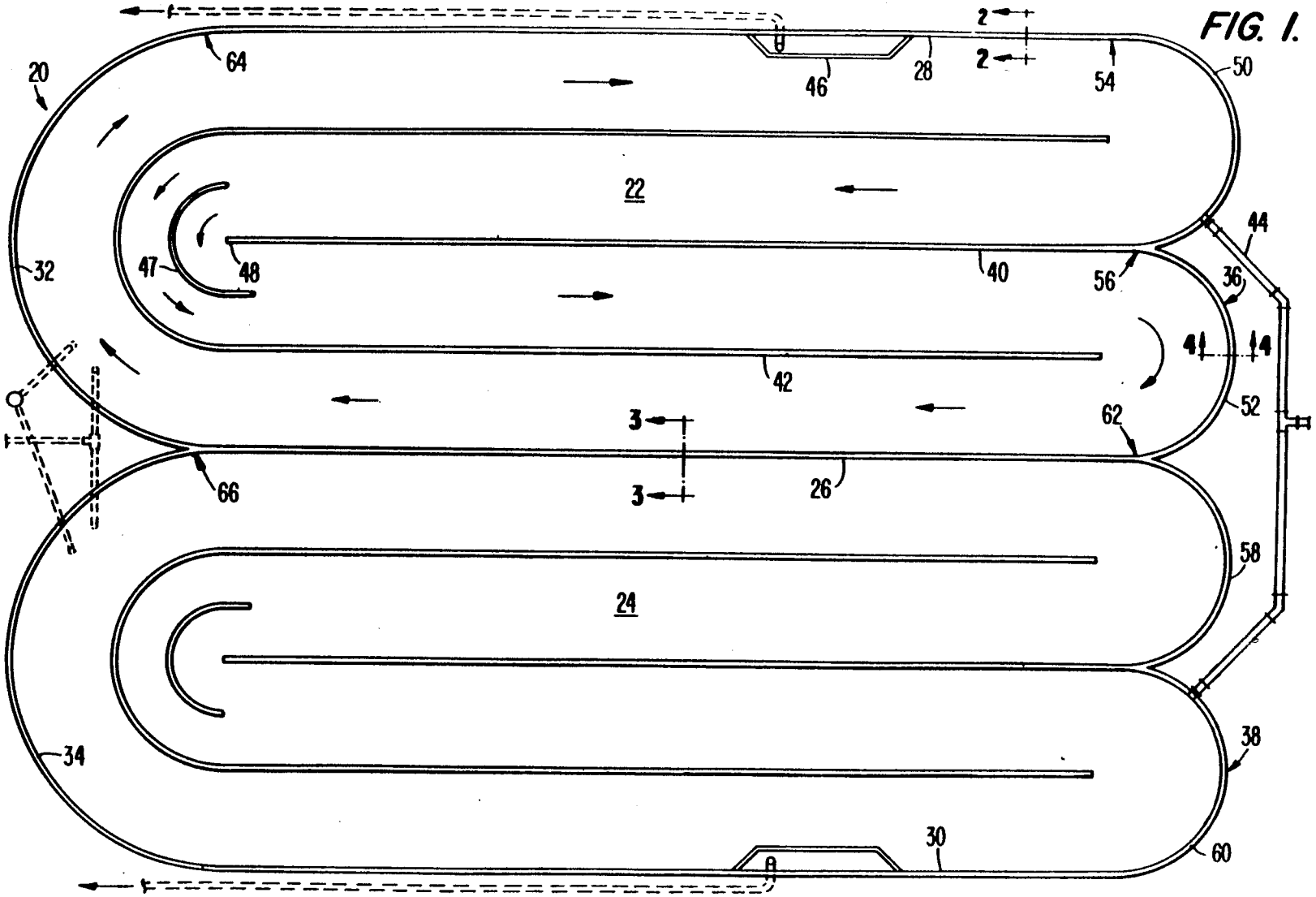
FIG. 1 is a plan view of a prestressed composite tank which embodies the principles and concepts of the present invention.

An elongated prestressed concrete tank structure which embodies the concepts and principles of the present invention and which was constructed utilizing the methodology provided by the present invention is illustrated in FIG. 1 where it is broadly identified by the reference numeral 20. Structure 20 comprises a pair of side-by-side tanks 22 and 24 which share a common wall 26. The tanks 22 and 24 have respective outer walls 28 and 30 and respective large diameter end walls 32 and 34 at one end of the structure. Each of the tanks 22 and 24 has a respective end wall 36 or 38 which is disposed at the opposite end of the tank from the end walls 32 and 34. As can be seen viewing FIG. 1, the end walls 36 and 38 each comprise a pair of side-by-side, semicircular end wall portions, each having a diameter which is essentially one-half of the width of the respective tank.

The tanks 22 and 24 are constructionally and operationally identical except that they are mirror images of one another. Accordingly, a detailed description of tank 22 will provide an adequate and appropriate description also of tank 24. In this regard, tanks 22 and 24 are actually operationally completely separate entities and are combined in the tank structure 20 simply to minimize the costs of construction by sharing common wall 26. Manifestly, if the tanks were not combined in the manner illustrated in FIG. 1, common wall 26 could be constructed identically with wall 28. In this same regard, wall 26 is constructed just as though it were an external wall since from time to time one or the other of tanks 22 and 24 may be emptied while the other remains in operation and thus the wall 26 must be capable of withstanding a full hydraulic load. In any event, the following description will focus upon tank 22 with the understanding that the description is equally applicable to the tank 24.

Tank 22 includes an internal central baffle wall 40 and a U-shaped baffle wall 42. Thus, tank 22, which may be used as an aeration tank, provides an elongated flow path for fluid materials introduced through an inlet 44. Fluid materials entering tank 22 through inlet 44 flow in the direction of the arrows in FIG. 1 and exit from tank 22 via effluent box 46. As shown, tank 22 also includes semi-circular baffle 47 which assists in directing the flow of fluid around the free end 48 of central baffle wall 40.

As can be seen viewing FIG. 1, end wall 36 spans the distance between walls 26 and 28. Moreover, end wall 36 consists of a pair of side-by-side semicircular wall portions 50 and 52. Thus, wall portion 50 spans the distance between and interconnects straight wall section 28 and baffle wall 40 while wall portion 52 spans the distance between and interconnects wall 26 and baffle wall 40.

Wall portion 50 and outer wall 28 are interconnected at a point 54 by means of structure illustrated in FIG. 8 and which will be described in more detail hereinafter. Wall portions 50 and 52 and wall 40 are interconnected at a point of connection 56 by structure illustrated in FIG. 9 which will also be described in further detail hereinbelow.

End wall 38, similarly to end wall 36, consists of a pair of side-by-side semicircular wall portions 58 and 60, as can best be seen in FIG. 1, and semicircular wall portion 52, semicircular wall portion 58 and common wall 26 are interconnected at a point of connection 62 by structure illustrated in FIG. 6 which will also be described hereinafter. For completion of the description in this regard, end wall 32 and outer wall 28 are interconnected at a point of connection 64 which has a structure that is essentially the same as the structure at point of connection 54. Moreover, end walls 32 and 34 and common wall 26 are interconnected at a point of connection 66 having a structure which is essentially the same as the structure of the tank at point of connection 62. Thus, it can be seen that end wall 32 is a generally semicircular wall which spans the distance between straight walls 26 and 28 and interconnects the ends of the latter. In this regard, end wall 32 has one extremity which abuts the end of wall 28 at point of connection 64 and another extremity which abuts the end of wall 26 at point of connection 66.

Figure 2:
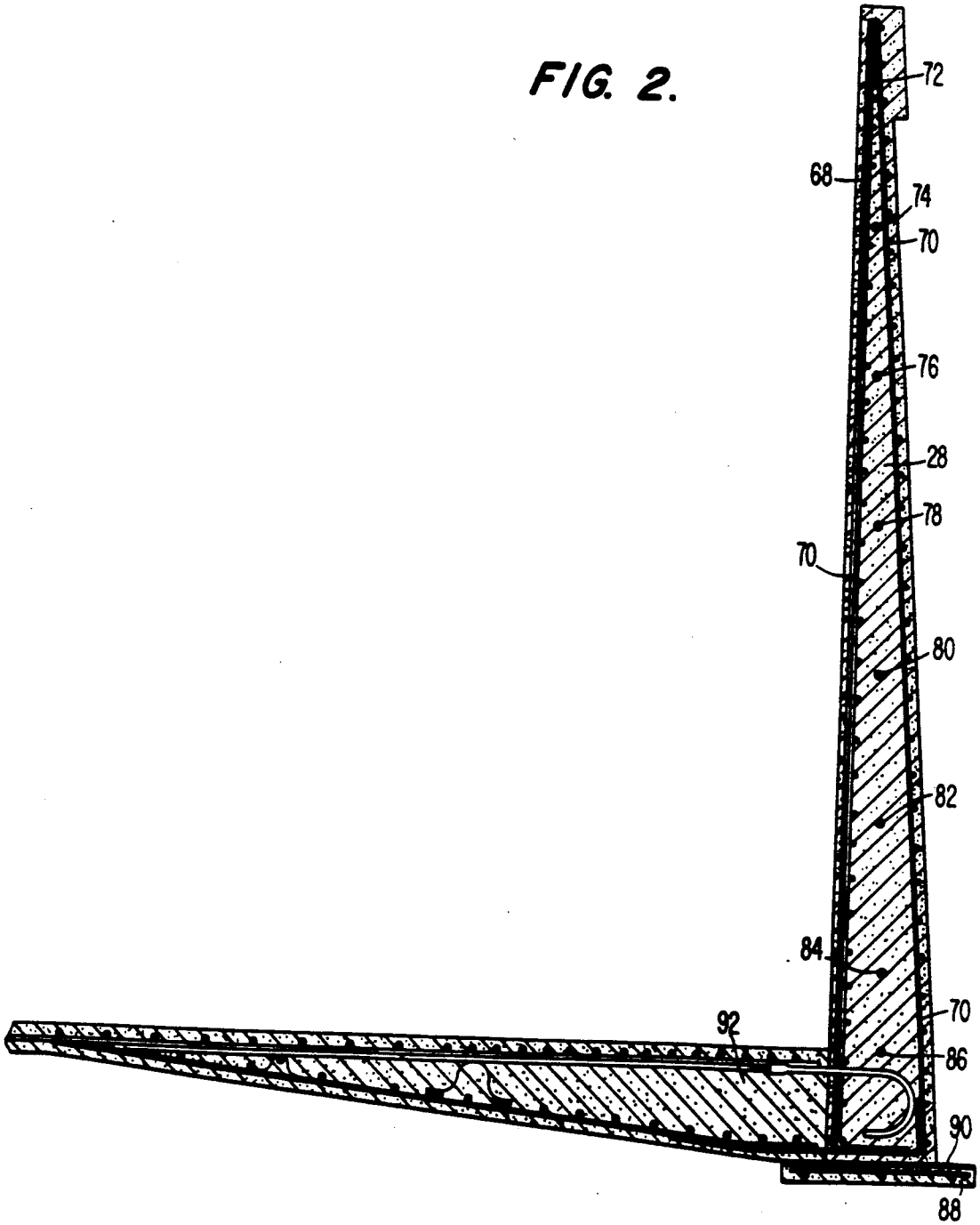
FIG. 2 is a vertical cross-sectional view of a straight, preshrunk, substantially crackless, elongated, wall section of the tank of the invention taken along the view line 2—2 of FIG. 1.

Viewing FIG. 2, it can be seen that straight wall 28 is generally trapezoidal in cross-sectional configuration and has a thickness at its bottom which is greater than its thickness at its top. This wall is of the type that is conventionally known as a cantilever wall and the same is designed to withstand the hydraulic forces imposed by water contained within the tank.

Wall 28 consists of a steel shell diaphragm 68 covered on both sides by a cementitious material. The joints between adjacent sections of the diaphragm may be sealed with a pumped grout as disclosed in the '520 patent identified above. Vertical and horizontal reinforcing steel, identified broadly by the reference numeral 70, may be incorporated into the wall in a manner which is conventional and well known to those skilled in the art. A series of threaded rods 72, 74, 76, 78, 80, 82, 84 and 86 are positioned to extend horizontally through the entire extent of the wall for a purpose that will be explained hereinafter.

Wall 28 is constructed atop a working slab or footing 88 which may be constructed of reinforced, poured concrete and plastic sheeting 90 is interposed between slab 88 and the bottom of wall 28 for the entire length and width of the latter. The purpose and function of plastic sheeting 90 and the sheeting itself will be described more fully hereinbelow. Tank 20 has a floor 92 which may be constructed of reinforced concrete. The construction of the floor 92 is conventional and does not form a part of the present invention. Suffice it to say, however, that floor 92 is constructed only after all of the straight, preshrunk walls have been completed.

Figure 3:
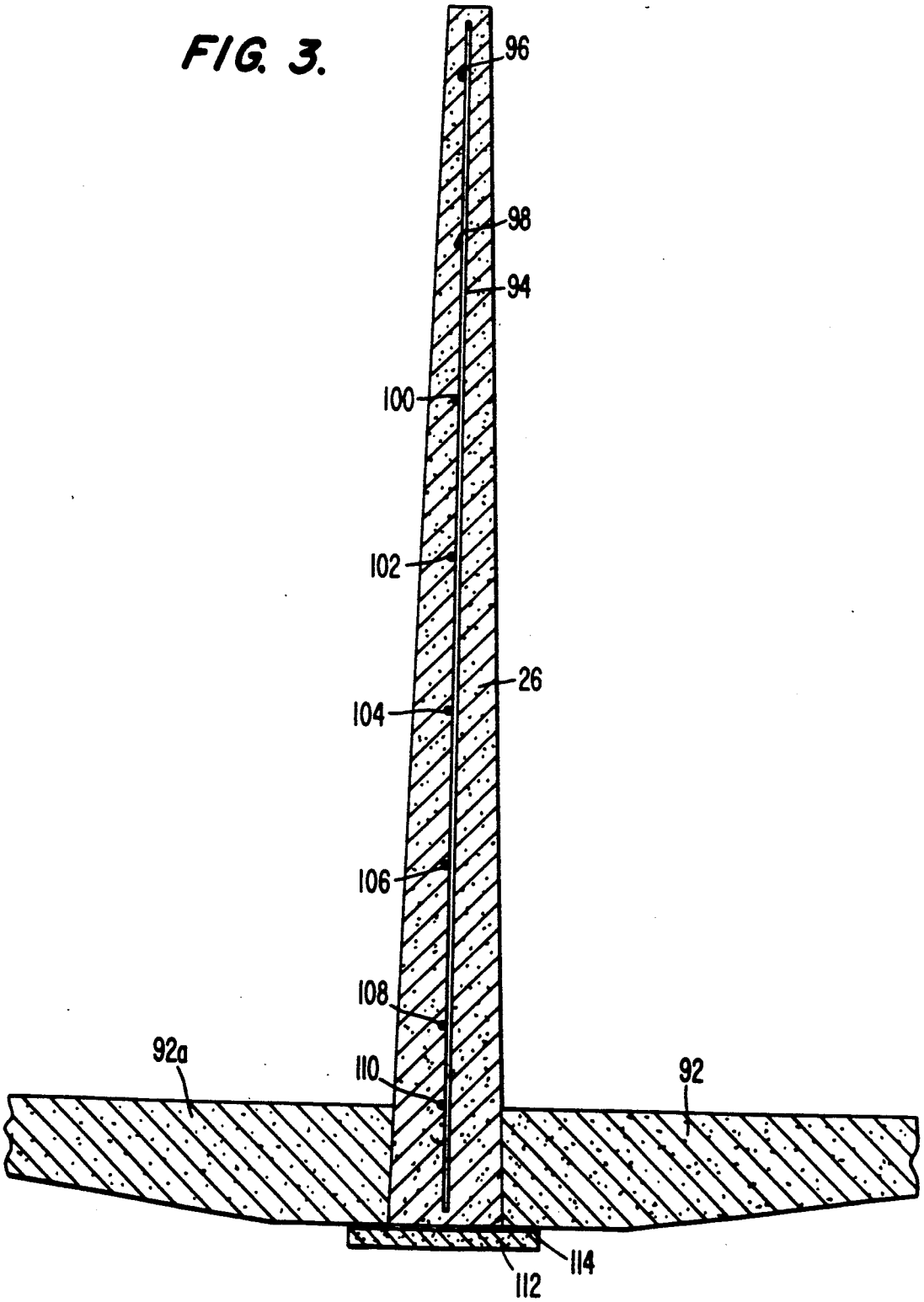
FIG. 3 is a vertical cross-sectional view of a straight, preshrunk, substantially crackless, elongated wall section constructed in accordance with the principles and concepts of the present invention and taken along the view line 3—3 of FIG. 1.

The cross-sectional construction and configuration of wall 26 is illustrated in FIG. 3. This wall is also of a cantilever type construction and thus has a thickness which increases from top to bottom. Wall 26 is constructed of reinforced cementitious material and incorporates a diaphragm 94, which again may be of the type illustrated in the '520 patent. In FIG. 3, the reinforcing steel has been deleted for improved clarity; however, those skilled in the art will appreciate that wall 26, like wall 28, should include reinforcing steel. Like wall 28, wall 26 also incorporates a series of horizontally extending threaded bars 96, 98, 100, 102, 104, 106, 108 and 110 which extend through the entire length of the wall for a purpose to be explained hereinafter. Also, wall 26 is constructed atop a working slab 112 of reinforced poured concrete and plastic sheeting 114 is interposed between slab 112 and the bottom of wall 26 and extends throughout the entire length and width of wall 26. Also seen in FIGS. 2 and 3 is the interrelationship between floor 92 and walls 26 and 28. The floor 92*a* of tank 24 is also seen in FIG. 3.

Figure 5:
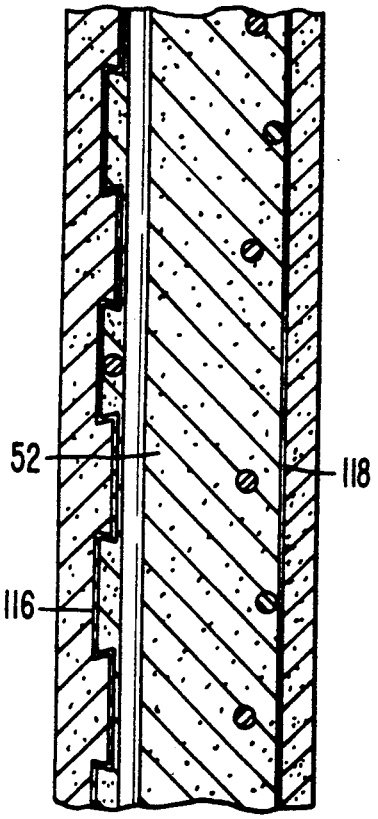
FIG. 5 is a horizontal cross-sectional view of the semicircular end wall taken along the view line 5—5 of FIG. 4.
Figure 4:
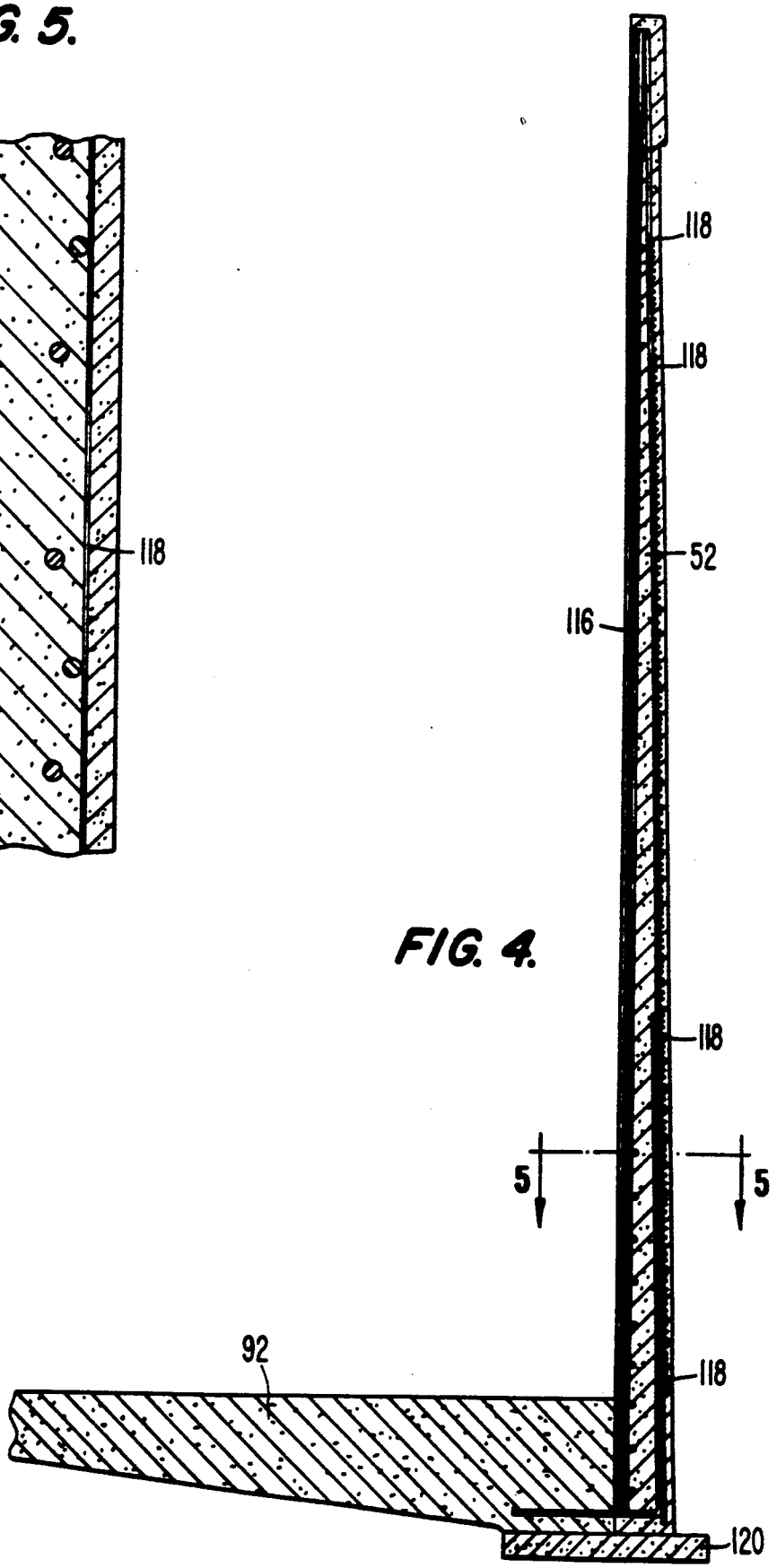
FIG. 4 is a vertical cross-sectional view of a semicircular end wall of the tank of FIG. 1 and taken along the view line 4—4 of FIG. 1.

The construction of end wall portion 52 is illustrated in FIGS. 4 and 5. Wall portion 52, like the other walls of the tank, incorporates a metal diaphragm 116 which may be a pumped joint diaphragm as illustrated in the above-mentioned '520 patent. Wall 52 includes both vertical and horizontal reinforcing steel which is deployed in a conventional manner, and the wall is prestressed, in a manner which will be explained in greater detail hereinbelow, utilizing prestressing wires or tendons 118. In this connection, the prestressing operation is known per se for circular tanks and is fully described in both the '520 patent and the '780 patent cited above. These principles are adapted for the present invention for use with semicircular wall sections. Such prestressing is for the purpose of applying centripetal forces to the entire periphery of the wall and thus place the same in circumferential compression. Wall 52 is constructed on a working slab 120 and cooperates with floor 92 and the other external walls to provide a water tight tank.

Manifestly, the construction of wall portion 50 and the construction of end wall 32 are similar to the construction just described for wall portion 52. Accordingly, it is not necessary to describe the construction of these walls in detail at this point. Suffice it to say that these walls also incorporate steel diaphragms similar to the diaphragm 116 and the same are placed into circumferential compression by the tension of prestressing wires or tendons similar to the wires 118 of wall portion 52.

Figure 6:
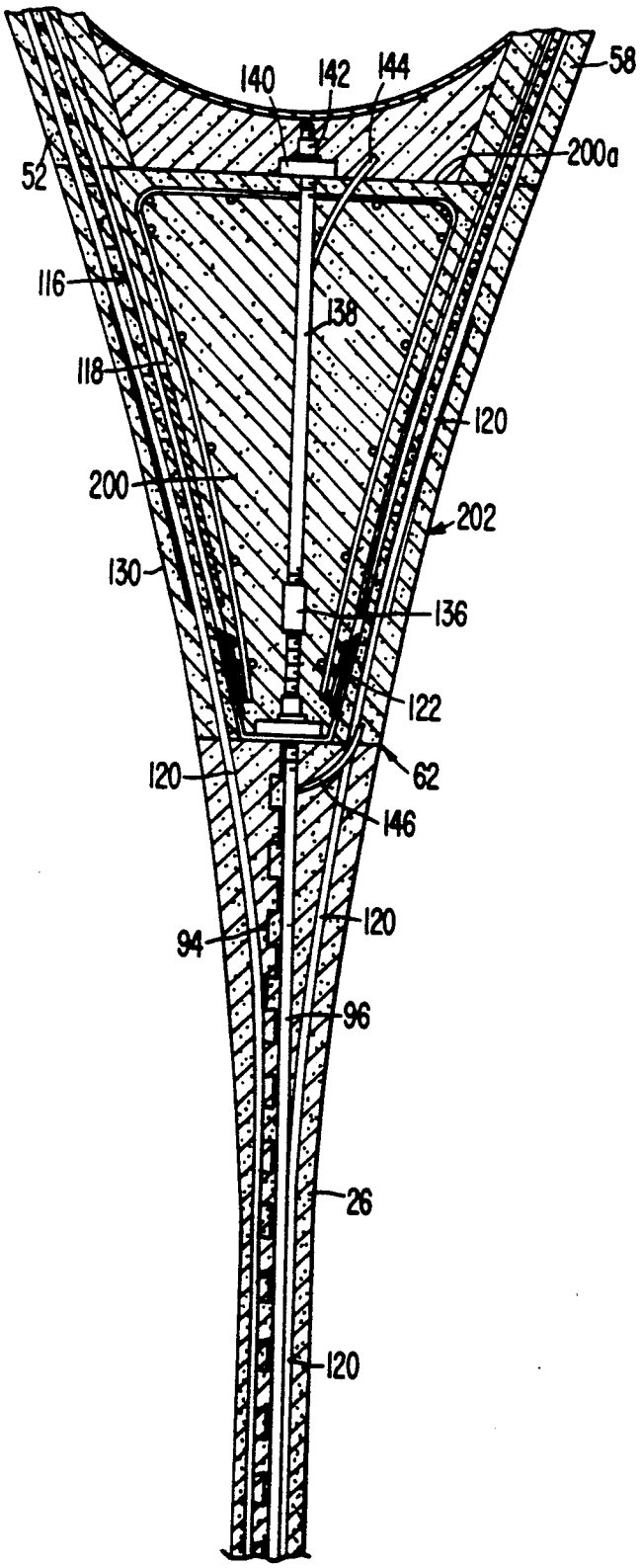
FIG. 6 is an enlarged, fragmentary, horizontal cross-sectional view of a keystone element constructed in accordance with the principles and concepts of the present invention and embodied in the tank illustrated in FIG. 1.

With reference to FIG. 6, the details of the construction of the structure 20 at connection point 62 is described. FIG. 6 is essentially a horizontal cross-sectional view taken at the level of bar 96 in wall 26. Thus, bar 96 and the edge of diaphragm 94 are visible, as are horizontal reinforcing steel rods 120. These latter are conventional and are identified simply for clarification. Also visible in FIG. 6 is the edge of the steel diaphragm 116 of wall 52 and one strand of the prestressing wire 118 for prestressing and placing wall 52 into compression.

Figure 7:
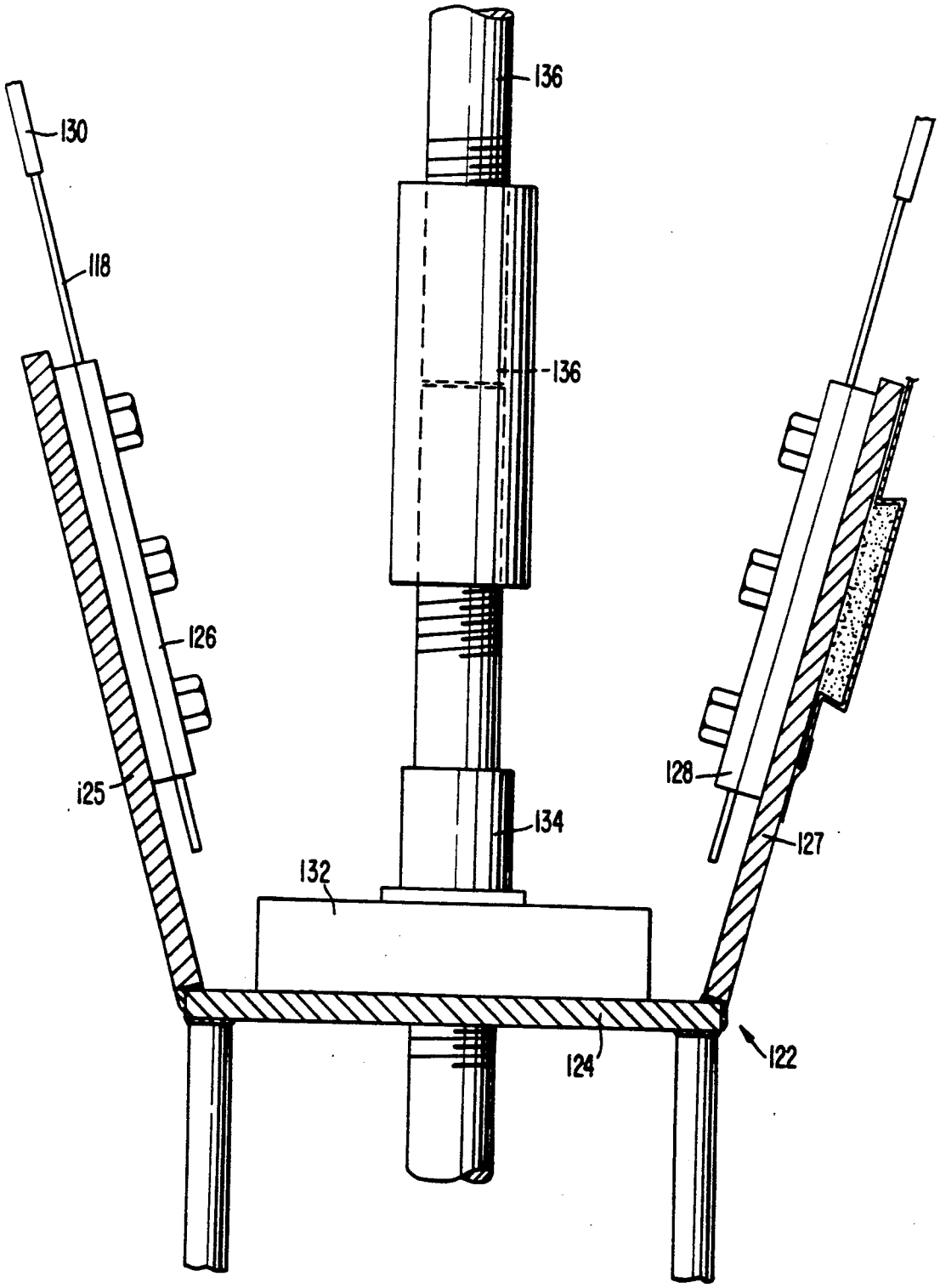
FIG. 7 is an enlarged, fragmentary view of a U-plate embodied in the keystone element of FIG. 6 and with the cementitious material removed for increased clarity.

Included in the construction of the tank at connection point 62 is a U-shaped plate 122 which is shown in greater detail in FIG. 7. In FIG. 7 it can be seen that U-shaped plate 122 includes a base plate element 124 and a pair of spaced plate members 125 and 127 which extend outwardly from element 124 and carry respective clamp structures 126 and 128. The plate 122 and its components are elongated and extend vertically for the entire height of wall 26. In this regard, plate element 124 has a respective hole therein for each of the bars 96 through 110 to extend through. Prestressing wires 118 are clamped into clamp 126 and are thus secured to U-shaped plate 122. Prestressing wires 118 are each provided with a wire splice element 130 which simply wraps around the wire and frictionally engages the same in a manner to prevent relative longitudinal movement of the wire relative to the splice element. The purpose of the wire splice element at this position is to provide better bonding between the wires and the cementitious material which will be applied over. and around the prestressing wires during the construction of the keystone.

The construction at point of connection 62 also includes a series of anchor plates 132 and nuts 134, the nuts 134 being threadably engaged on the ends of threaded bars 96 through 110 and disposed in bearing relationship relative to a respective plate 132 and plate element 124, all for a purpose which will be described in detail hereinafter. Also included in the construction at point of connection 62 are respective threaded couplings 136 and extensions 138 for each bar 96 through 110, a second series of anchor plates 140 similar to plates 132 and a second series of nuts 142 which are similar to the nuts 134. Again, the purpose of these various elements will be described in detail hereinbelow where the constructional procedure is set forth in detail.

In the space between walls 52 and 58, the various components shown in FIG. 6, and which form a part of the construction at point of connection 62, are coated with a cementitious material such as shotcrete. Prior to the application of the shotcrete, grout tubes 144 and 146 may be installed at each horizontal bar. The purpose of the grout tubes will be explained hereinbelow.

Figure 8:
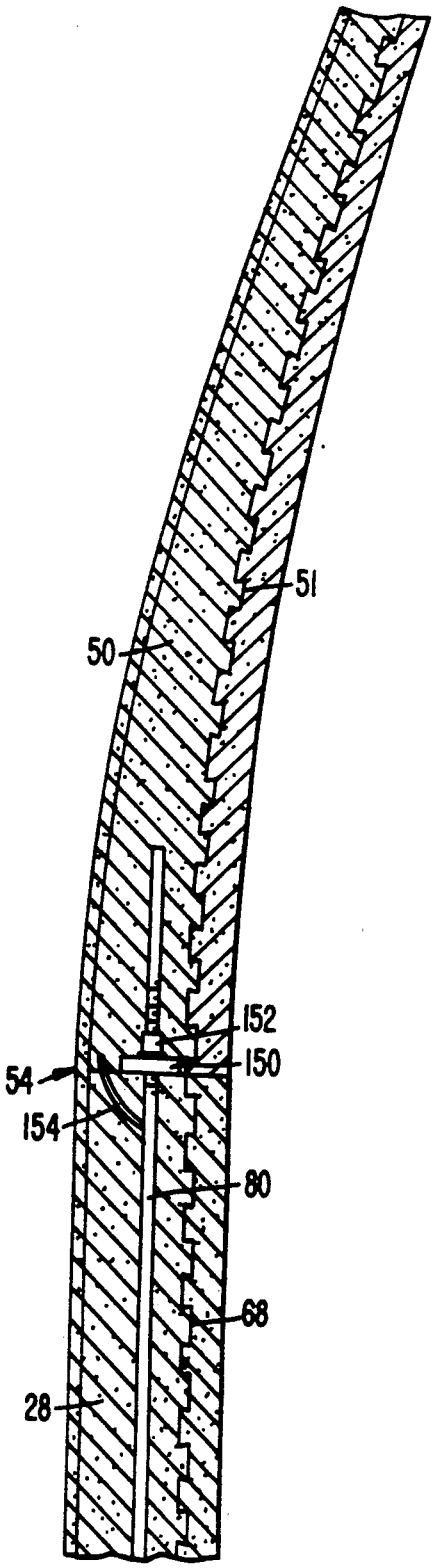
FIG. 8 is an enlarged, horizontal cross-sectional view of a portion of the tank of FIG. 1 illustrating the abutment between an end wall and an outside straight tank wall.

The construction of the tank at the point of connection 64 is illustrated in detail in FIG. 8. FIG. 8 is a cross-sectional view of straight wall 28 and end wall 36 at their point of connection 54. The view is taken approximately at the level of bar 80 which extends horizontally through wall 28 as shown. Also illustrated in FIG. 8 are the diaphragm 68 of wall 28 and the diaphragm 51 of wall 50. At the point where the circumferential extremity of wall 36 abuts the end of wall section 28, an anchor plate 150 is provided for each bar 72 through 86 and a nut 152 is threadably engaged on the end of each rod 72 through 86 in a position for bearing against its respective plate 150 and pressing the same against the end of wall 28. Again, the exact purpose and function of each of these components will be described in greater detail hereinbelow during the description of the procedure for constructing the tank.

A grout tube 154 is installed adjacent each bar prior to shotcreting. In this connection, it is to be understood that for purposes of the present construction involving walls that are approximately 205 feet long, each of the horizontally extending bars 72 through 86 in wall 28 and each of the bars 96 through 110 in wall 26 should preferably be a 1" steel rod and the same should preferably be provided with an annular sheath for the full length of the bar. The sheath is simply a thin metal tube, approximately 1¼" in ID, which is placed around the bar leaving a small annular space between the bar and the inside of the sheath. Both the inside and the outside surfaces of the sheath and the outside surface of the bar are provided with spiral irregularities, in a manner known to those skilled in the art, so that when the annular space between the sheath and the bar is filled with a grout and the outside of the sheath is coated with shotcrete, an excellent bond is provided between the bar and the wall and the bar is protected from corrosion. The tubes 154 provide access for pumping grout into the space between the sheath and the bar after the cementitious material has been applied.

Figure 9:
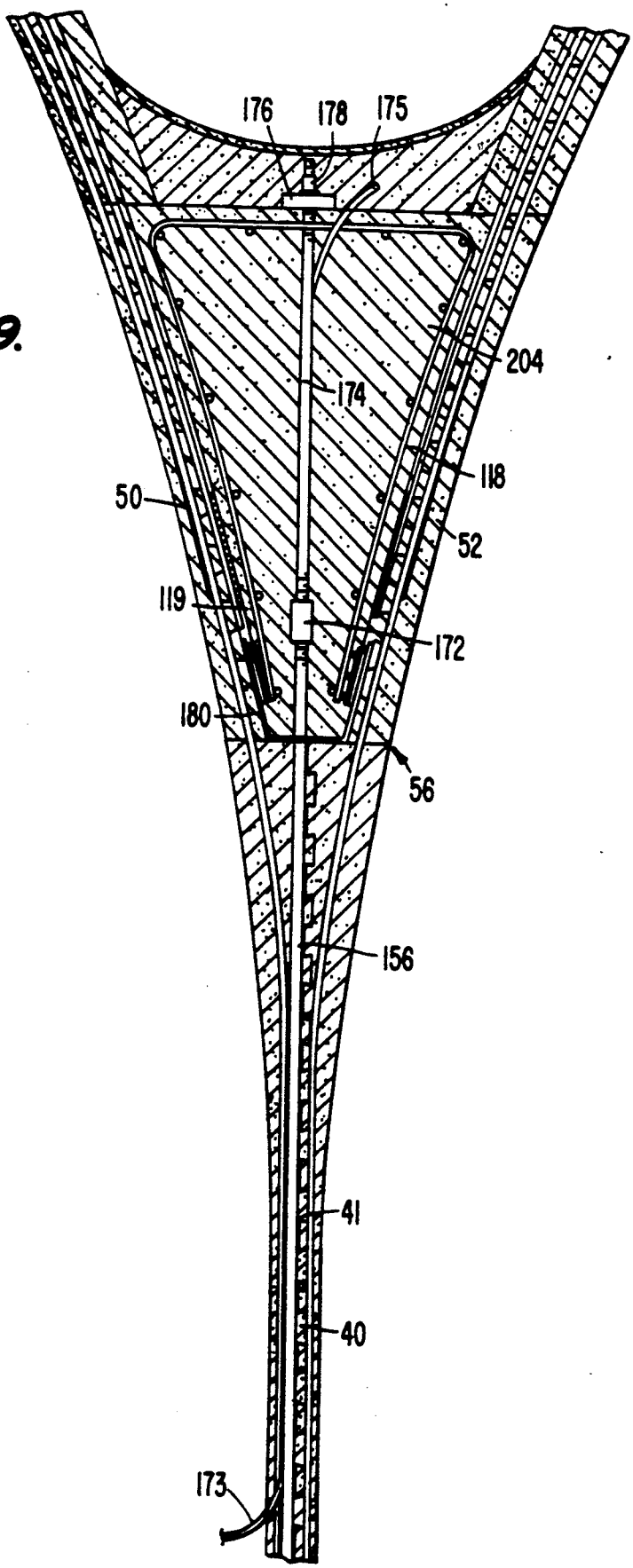
FIG. 9 is an enlarged, horizontal cross-sectional view of a portion of the tank of FIG. 1 illustrating the construction of the keystone used for joining end wall sections to a baffle wall.
Figure 10:
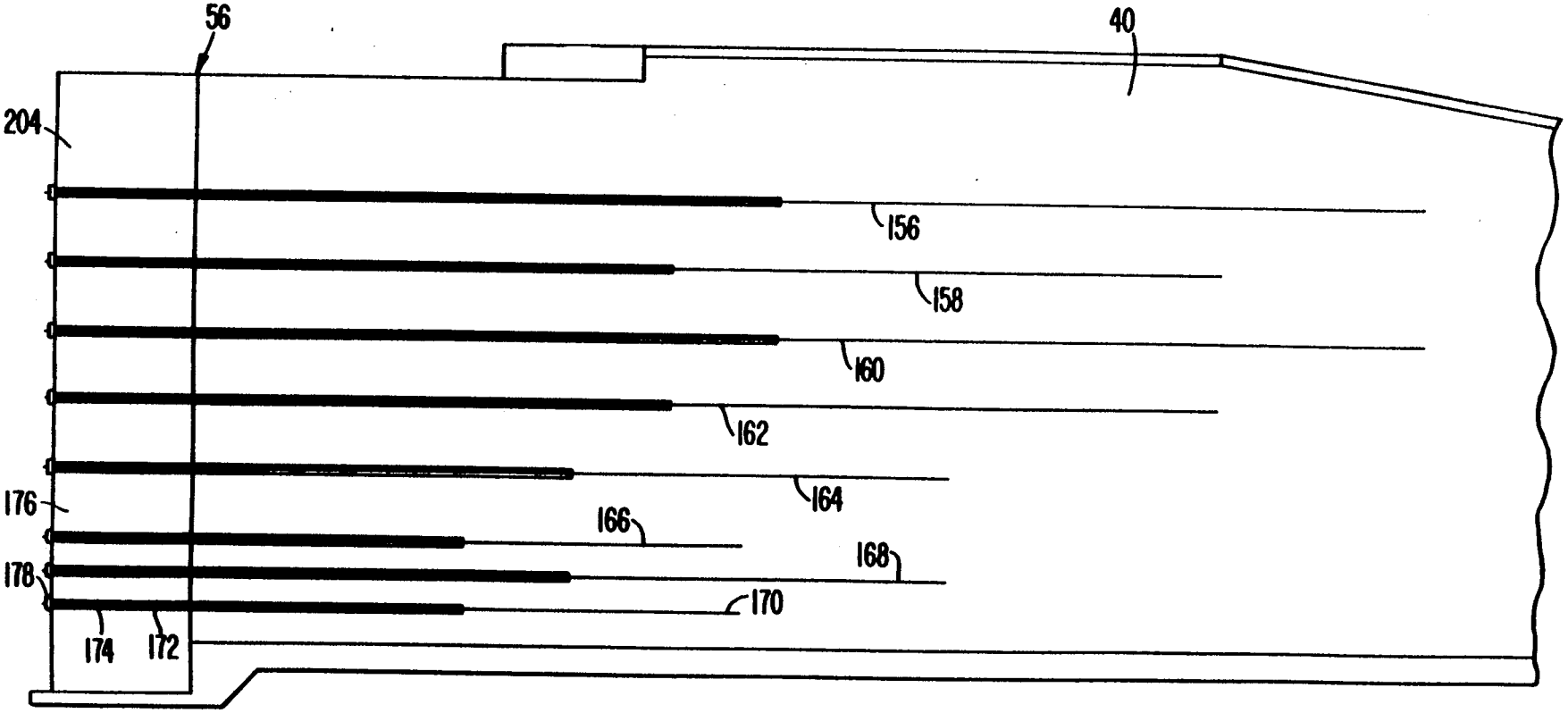
FIG. 10 is an elevational, schematic view illustrating the interconnection between the keystone element of FIG. 9 and the baffle wall.

The structural details of the tank at point of connection 56 are illustrated in FIG. 9. Here the construction is similar to the construction at point 62, as illustrated in FIG. 6, except that in this case there is no necessity for the inside nuts and anchor plates since there is no necessity for preshrinking central baffle wall 40 to prevent cracking because the latter will have equal hydrostatic pressures on each side in service. Since the wall is not a hydrostatic pressure resisting wall, shrinkage cracking is not a significant problem. A series of threaded horizontal bars 156 through 170 are incorporated into the end of wall 40 adjacent connection point 56 and FIG. 9 is a horizontal cross-sectional view looking downwardly from about the level of bar 156. The vertical placements and horizontal extensions of bars 156 through 170 are illustrated schematically in FIG. 10 where it can also be seen that each bar is provided with a sheath which covers a portion of its length, the sheaths otherwise being as described above in connection with bars 72 through 86 and bars 96 through 110. Grout tubes 173 and 175 are provided for grouting each bar 156 through 170 for the purposes set forth above.

The bars 156 through 170 are provided with respective couplings 172 and threaded extensions 174. Also provided at point 56 are anchor plates 176 similar to the plates 140 at point 62 and a series of nuts 178 which are threadably engaged on respective extensions 174. A U-shaped plate 180, which may be identical with the U-shaped plate 122 illustrated in FIG. 7, is provided and the same includes respective clamp means for anchoring the prestressing wires or tendons 118 for wall portion 52 and the corresponding wires or tendons 119 for wall portion 50.

Figure 11:
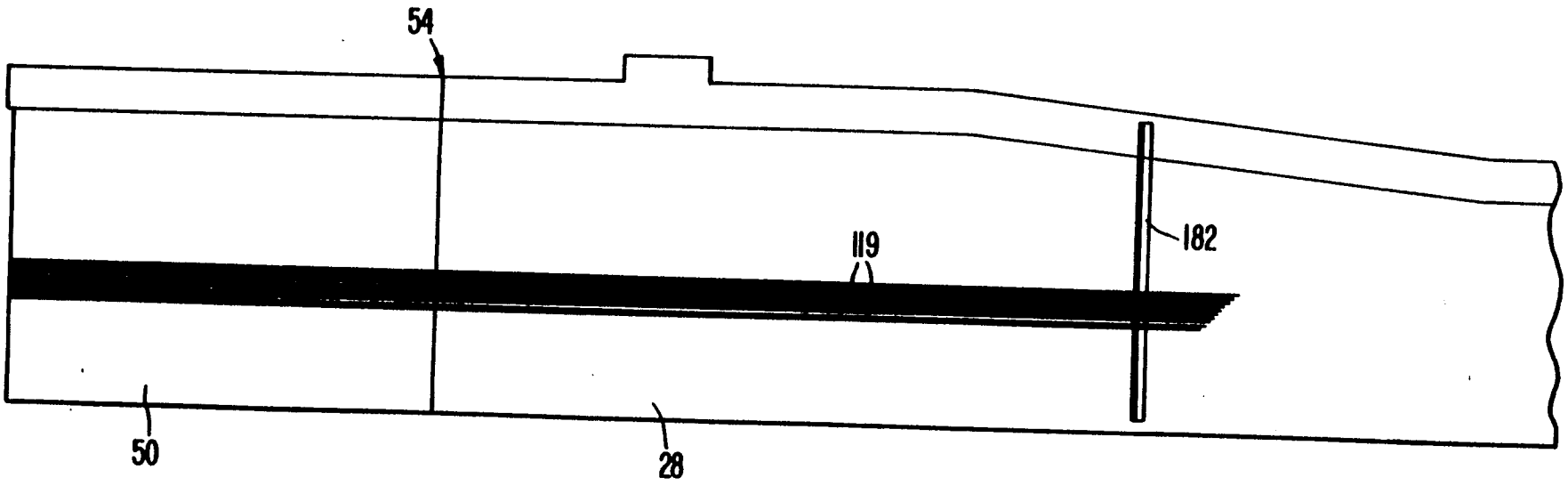
FIG. 11 is a partial elevational view of one end of the tank of FIG. 1 and illustrating the end wall prestressing procedure.

With reference to FIG. 11, it can be seen that prestressing wires 119 extend around end wall 50 from point of connection 56 where they are securely clamped by U-shaped plate 180, to an angle element 182 attached to wall 28. A series of holes are provided in angle 182 and each wire 119 is secured to angle 182 by a device known in the relevant art as a torpedo. Such holding devices simply provide a one-way friction element which permits insertion of the wire in one direction but frictionally prevents removal of the wire in the other direction. There are a number of such devices available commercially and they are used simply to facilitate anchoring of the wires. After the wires are secured at one end by the torpedos at angle 182 and at the other end by the clamp on U-shaped plate 180, the same may be tightened at the mid-point of end wall 50 by procedures described in greater detail hereinbelow.

The prestressing wires 118 around end wall 52 are secured at one end (at connection point 56) by the clamp means of U-shaped plate 180 and at the other end (at connection point 62) by the clamp 126 of U-shaped plate 122. Similarly, the prestressing wires for end wall 32 are secured at one end (near connection point 64) by an angle and torpedos similar to the angle 182 and its corresponding torpedos, and at the other end (at point 66) by a clamp which forms a part of a U-shaped plate identical with U-shaped plate 122. In this regard, the construction of the tank at connection point 66 is essentially the same as the construction of the tank at connection point 62. Moreover, the construction of the tank at connection point 64 is essentially the same as the construction of the tank at connection point 54. The only differences being those resulting from the differences in the degrees of curvature of the walls since wall 32 has a diameter which is about twice as large as the respective diameters of wall portions 50 and 52.

With reference to wall 28, the construction procedure is as follows. First, the working slab or footing 88 is cast from a cementitious material, which may be a concrete, and the upper surface is finished to provide a smooth and level surface. Plastic sheeting 90 is then placed on top of slab 88 in a manner to extend across the full width and length of slab 88. Essentially any sort of sheeting which is rugged and which reduces the friction between the bottom of the wall and the surface of the footing and which therefore facilitates slight longitudinal movements of the bottom of the wall relative to the footing will suffice. However, for a wall constructed of cementitious material and which is approximately 15½ feet tall and 205 feet long, it has been found that a system using 8 sheets of 4 mil thickness polyethylene is capable of facilitating the necessary movement of the bottom of the wall during preshrinking. At least in part, the friction is reduced by the slippage of one such sheet of plastic on another such sheet of plastic. Useful polyethylene film is available commercially and is known in the trade as visqueen sheeting.

Working slab or footing 112 for wall 26 is also cast to provide a very smooth and level upper surface and plastic sheeting 114 is placed across the full width and length of slab 112. In general, sheeting 114 should preferably be the same as sheeting 90. Working slabs are also constructed for each of the other walls; however, it is only the walls 26, 28 and 30 which need to be preshrunk and which therefore need be provided with the friction reducing plastic sheeting means to permit at least slight longitudinal movement of at least portions of the wall section during the preshrinking operation to be described in detail hereinafter.

After all of working slabs or footings have been constructed, and the plastic sheeting applied to the working slab footings for walls 26, 28 and 30, the walls themselves may be constructed. The floor 92 of the tank may be cast after the completion of all of the walls.

After the footings completed the straight walls and end walls are constructed. The procedure for construction at point of connection 62 may be more fully understood with reference to FIG. 6. First, the diaphragm 94 for the straight wall is erected. Thereafter the threaded bars 96 through 110 are placed in position along with their sheaths. The U-shaped plate 122 is positioned with the ends of the bars 96 through 110 extending through the holes in plate 122, and a respective anchor plate 132 and nut 134 is placed on each bar. The faces of the wall are then shotcreted and the reinforcing steel is put in place during the shooting. The walls are completed to the back of plate element 124 of U-shaped plate 122 which is positioned at the preselected end point for the wall. As a preliminary procedure, the grouting tubes 146 are installed prior to the shooting of the wall with shotcrete so as to extend outside the wall 26 after the same has been completed up to the back of the plate element 124.

The other end of wall 26, at connection point 66, is constructed in an essentially identical manner so that upon the completion of the shooting of the wall there is a U-shaped plate at each end of the wall and a respective anchor plate and nut positioned at each end of each of the bars 96 through 110. The nuts are then in a position to be tightened to place the wall into compression at the appropriate time.

As is usual in shotcrete type construction, it is often desirable to allow the cementitious material to achieve high strength under conditions where the wall is moist and shrinkage is retarded. Known procedures are utilized for testing the strength. The structure is kept in a moistened condition to keep significant shrinkage from occurring during the curing process until the cementitious material has aged enough so that high strength has been achieved. This may be done by simply playing streams of water on the wall during the curing operation. It may take a month or so for the wall to cure appropriately to achieve the required high strength so that the process can then be continued.

After the curing has proceeded to the point where the strength of the cementitious material is sufficiently high, the water streams are discontinued and the wall is put into end-to-end compression by tensioning the bars 96 through 110 and tightening the nuts at the end of the bars. The tensioning of bars 96 through 110 may be accomplished using conventional equipment such as a hydraulic pump equipped with a grabber element which grasps the end of the bar and pulls it longitudinally. The nuts are brought up snug while the tension is being applied. A total compressive force in the order of 600,000 pounds was found to be operable in the case of a wall which is 205 foot long and 15½ foot high. The wall is then permitted to shrink or contract or shorten (these terms are used synonymously) while the compressive pressures are maintained on the ends of the wall. The preshrinking process may take as much as three weeks and during this period a cementitious wall which is about 205 feet long will shrink approximately 1½ inches. In this regard, the cementitious materials which are used in connection with tanks of the sort to which the present invention pertains generally have coefficients of shrinkage ranging from 0.0004 to 0.0015 inches per inch.

Manifestly, the plastic sheeting 114 positioned beneath wall 26 reduces the friction at the base of the wall so as to permit slight longitudinal movements of the wall as a unitary structure to occur. This facilitates longitudinal shrinkage of the wall and essentially prevents cracking. It has been found that the end-to-end compressive forces imposed on the ends of the walls utilizing bars like the bars 96 through 110, nuts like the nuts 134, anchor plates like the plates 132 and U-shaped plates like the plates 122, in combination with a reduction of friction such as is made possible through the use of plastic sheeting like the sheeting 114, makes the construction of preshrunk walls possible in the essential absence of cracking.

After the completion of the preshrinking phase for wall 26, the circumferential diaphragms for the walls 52 and 58 are placed in appropriate positions as shown in FIG. 6. Similarly, the diaphragms for the walls 32 and 34 are positioned at the other end of the tank in the same manner. At the same time the reinforcing steel is positioned adjacent each semicircular diaphragm. The outer sides of the end walls are then shot with shotcrete or the like, the joints to be pumped in accordance with the '520 patent are cleaned and taped, including the joints between the diaphragm and the U-shaped plate.

After the pump joints have all been cleaned and appropriately taped, the end walls are shotcreted. Thereafter, the prestressing wires are positioned to extend around each end wall with the ends of the prestressing tendons restrained by the clamps of the corresponding U-shaped plate, or the angles on the outer walls as the case may be.

The foregoing description presupposes that all of the other walls of the tank have been completed. To the extent that the construction of the other walls differs from the construction of wall 26, such differences will be noted specifically hereinafter. Meanwhile, it is simply presumed, for purposes of the present description, that the wall 28, the wall 30 and the wall in the center of tank 24 have each been constructed and have been preshrunk similarly to the preshrinking of the wall 26. In any event, the prestressing wires or tendons are stretched around each end wall with a tension, for the time being, which is just enough to hold each wire tightly in place.

At this point, the nuts 134 and the anchor plates 132 may be removed from the U-shaped plate 122 and retained for use later as will be described. A respective coupling 136 and a respective threaded extension 138 may be placed on the free end of each of bars 96 through 110. Thereafter, the area between walls 52 and 58 is filled with cementitious material 200 to a position beyond the clamps holding the ends of the prestressing wires. In this regard, each prestressing wire may be wrapped with a splice element to insure an appropriate bond between the cementitious material 200 and the wires and the cementitious material will extend to a point which is substantially beyond the length of the splice. As explained above, the splice is a commercially available device which wraps around the wire, and once in place it prevents relative longitudinal movement of the wire relative to the splice element. Generally speaking, these splice elements are utilized to hold loose ends of a wire together; however, in the present case, the wire is not held together by the splice but rather the splice is used simply to prevent longitudinal shifting of the wire and thus provide a better bond between the wire and cement block 200.

Prior to completion of the filling of the area between walls 52 and 58 with cementitious material 200, a grout tube 144 may be positioned as shown in FIG. 6 adjacent each of the extensions 138. Cementitious material 200 extends outwardly to a point near the ends of extensions 138 and a flat surface **200*a* is provided at that point. An anchor plate 140 (which may in fact be an anchor plate 132 which was removed) is placed on surface 200*a* at each extension 138 of the concrete and a nut 142 (which may be a nut 134 which was previously removed) is placed on the end of each of the extensions 138 and the latter are placed into tension and the nuts 142 tightened. The U-shaped plate 122 and the cementitious material 200 filling the area between end walls 52 and 58 up to the backs of anchor plates 142 present a generally trapezoidal keystone 202 which operates to transfer forces between the semicircular walls 52 and 58 and the straight wall 26. In this regard, the keystone 202** may be provided with reinforcement steel as is appropriate.

Since the construction at point 66 is essentially the same as the construction at point 62, a keystone which is essentially identical to keystone 202 is provided at connection point 66. After these keystones have been completed and the extensions 138 tensioned, and nuts 142 tightened, the prestressing wires are all tensioned at the mid-point of each semicircular wall. The tensioning is done utilizing a conventional technique and device whereby the wire is grabbed left and right, the wire is snipped in two and drawn from each side and a splice is installed to hold the snipped ends of the wire together.

After the prestressing tendons have been appropriately snipped, tightened and spliced, the wires are covered with a coating of cementitious material. This procedure is conventional in the prestressed composite tank art. After the walls have been completed, bars 96 through 110 and the extensions 138 may be grouted from the outside through grouting tubes 144 and 146. Finally, the area between walls 52 and 58 may be filled with shotcrete to a level to cover the ends of the extensions 138 as well as the anchor plate 140 and the nuts 142 and provide a finished appearance.

With reference to FIG. 8, the construction of connection point 54 between straight wall 28 and end wall 36 is illustrated. In completing this structure, the straight wall 28 is first completed with the diaphragm 68 disposed inside of the bars 72 through 86. The diaphragm and the threaded bars 72 through 86 are then covered with shotcrete and the wall 28 is built up to an appropriate thickness complete with reinforcing bars pursuant to conventional techniques. As in the case of wall 26, the wall 28 is kept in a moistened condition by spraying it with water until the concrete has achieved the required high strength. After high strength has been achieved by appropriate curing of the wall using essentially the same procedure as was used in connection with wall 26, anchor plates 150, which are essentially the same as anchor plates 132, are placed at the end of the wall as shown in FIG. 8 and the entire wall is subjected to end-to-end compression by tensioning bars 72 through 86 and tightening of the nuts 152. In this regard, a nut 152 is threadably received on the end of each of the bars 72 through 86. Moreover, it should be appreciated that the construction of the tank at point of connection 64 is essentially the same as the construction of the tank at point 54, and thus there are plates similar to the plates 150 at the end of wall 28 adjacent point of connection 64 as well as a nut for each of the bars. The bars may be tensioned and the nuts tightened at either end to provide the compressive forces necessary during the preshrinking operation.

Manifestly, the construction of the wall 28 may be carried on contemporaneously with the construction of wall 26. Also, the wall 30 may be constructed essentially at the same time. In any event, it will be apparent to one of skill in the art that the walls 26, 28 and 30 must all be constructed and fully preshrunk before the construction of the end walls can be accomplished. The placing of each straight, hydraulic pressure containing wall into end-to-end compression during the preshrinking stage coupled with the presence of the anti-friction means in the nature of the plastic sheeting beneath the base of the wall to reduce friction, allows the shrinking of the wall to take place without substantial cracking of the wall, to thus provide a preshrunk, substantially uncracked wall. Baffle wall 40, as well as the corresponding baffle wall disposed between walls 26 and 30, must be fully constructed before the end walls can be completed, at least in the structure which has been described in the present application.

As has been explained previously in connection with the construction of wall 26, each of the bars 72 through 86 of wall 28 is provided with a sheath, and grouting tubes 154 are provided for each bar so that the annular space in each sheath may be grouted upon completion of the wall.

To complete the construction and prestressing of the semicircular walls, angles such as the angle 182 are attached to the wall 28 at a point which is sufficiently beyond the connection point to insure appropriate transfer of forces between the semicircular end wall and the straight wall to which it is attached. In the case of a 205 foot long straight wall section, it has been found to be appropriate for the angle to be placed a distance about 30 feet from the connection point. After the prestressing wires are anchored and tensioned, the same are coated with an outer coating of shotcrete.

The construction at point of connection 56 is essentially the same as the construction at point of connection 62 except that in this case, the wall 40 need not be preshrunk since it is not a wall which must resist hydraulic pressure. Rather, wall 40 is simply a baffle wall utilized for the purpose of directing the flow of fluid in the tank during operation. Thus, the bars 156 through 170 do not need to run the full length of the wall and instead are used simply to secure the keystone 204 at connection point 56 and facilitate appropriate transfer of forces between wall 40 and end walls 50 and 52.

The constructional details of the tank at connection point 56 are shown in FIG. 9. During the construction of the tank, the diaphragm 41 is erected and the threaded bars 156 through 170 are positioned along with their respective sheaths and corresponding grout tubes as set forth above. The bars 156 through 170 do not extend the entire length of the wall 40 and the positioning thereof is shown schematically in FIG. 10. After the diaphragm, the bars 156 through 170 and the reinforcing steel for wall 40 have been positioned properly, the cementitous material for the wall is applied by shotcreting. The cementitious material is applied and the wall is completed up to the base of U-shaped plate 180. The diaphragms for walls 50 and 52 are then erected and reinforcing steel is positioned for the semicircular walls. The walls are completed as before. Couplings 172 and extensions 174 are installed on each of the bars 156 through 170 and the keystone 204 is cast between walls 50 and 52. After keystone 204 has been cast, the prestressing wires are tensioned and spliced as set forth above and the wires are coated with cementitious material. Thereafter, the anchor plates 176 and the nuts 178 are installed and the bars 156 through 170 are placed in sufficient tension so that forces may appropriately be transferred between the walls connected by the keystone 204 at connection point 56. Grout is pumped through the grout tubes to grout the bars and a cover coat is shot over the anchor plates 176 and nuts 178, essentially to the configuration illustrated in FIG. 9.

As can be seen viewing FIG. 1, the walls 26, 28, 32, 50 and 52 define an elongated prestressed concrete tank. The walls 26 and 28 are each comprised of straight, preshrunk, substantially uncracked, elongated wall sections, and end walls 32 and 50 each comprise a generally semicircular, prestressed end wall having a pair of circumferentially spaced extremities, one of which is disposed in generally abutting relationship with respect to an end of a straight wall section. Moreover, the tank 20 comprises a pair of elongated, generally parallel, laterally spaced, preshrunk, substantially uncracked straight wall sections 26 and 28 and a pair of prestressed end walls 32 and 36.

I claim:

1. A method for constructing an elongated concrete tank for holding liquid comprising:

forming at least a pair of generally parallel, laterally spaced, straight, elongated, upright wall sections from an initially flowable, hardenable cementitious material;

subjecting the cementitious material in the wall sections to curing conditions under which the wall sections are maintained in a moistened condition and shrinkage thereof is thereby retarded until the strength of the cementitiouos material is sufficiently high to permit application of end-to-end compressive forces to the wall sections;

essentially immediately after the strength of the cementitious material is sufficiently high to permit said application of said end-to-end forces, discontinuing the conditions for keeping the wall sections in a moistened condition and applying end-to-end compressive forces of a given magnitude to the wall sections during shrinkage of the cementitious material so as to cause shrinkage to occur under the influence of said compressive forces;

constructing end walls of cementitious material in abutting and adjoining relationship to the ends of the wall sections after shrinkage of the latter; and thereafter prestressing the end walls by applying compressive forces thereto.

2. A method for constructing a tank as set forth in claim 1, wherein is included the steps of providing means for reducing resistance to movement and placing the same beneath each wall section during the forming of the latter so as to thereby permit at least slight longitudinal movement of at least a portion of each wall sections during application of said end-to-end compressive forces.

3. A method for constructing a tank as set forth in claim 2, wherein said means for reducing resistance to movement includes plastic sheet means.

4. A method for constructing a tank as set forth in claim 1, wherein at least one of said end walls is formed in a semicircular shape and said step of prestressing the same comprises stretching a plurality of wire tendons peripherally around the semicircular end wall in a position for exerting centripetal forces thereon.

5. A method for constructing a tank as set forth in claim 1, 2, 3 or 4, wherein said step of applying end-to-end compressive forces to the wall sections includes providing a plurality of threaded rods to extend longitudinally through each wall section, tensioning the rods, and threading a nut onto an end of each rod and into bearing and force transferring relationship against an end of the respective wall section.

6. A method for constructing a tank as set forth in claim 1, wherein the cementitious material in the wall sections is kept moist during the period of time the cementitious material is subjected to curing conditions by playing streams of water on the wall sections.

7. A method for constructing a tank as set forth in claim 5, wherein the cementitious material in the wall sections is kept moist during the period of time the cementitious material is subjected to curing conditions by playing streams of water on the wall sections.

8. In a method for constructing an elongated concrete tank for holding a liquid, the steps comprising:

forming a straight, elongated, upright wall section from an initially flowable, hardenable cementitious material;

subjecting the cementitious material in the wall section to curing conditions under which the wall section is maintained in a moistened condition and shrinkage thereof is thereby retarded until the strength of the cementitious material is sufficiently high to permit application of end-to-end compressive forces to the wall section; and essentially immediately after the strength of the cementitious material is sufficiently high to permit said application of said end-to-end forces, discontinuing the conditions for keeping the wall section in a moistened condition and applying end-to-end compressive forces of a given magnitude to the wall section during shrinkage of the cementitious material so as to cause shrinkage to occur under the influence of said compressive forces.

9. A tank construction method as set forth in claim 8, wherein is included the steps of providing means for reducing resistance to movement and placing the same beneath the wall section during the forming of the latter so as to permit at least slight longitudinal movement of at least a portion of the wall section during said application of said end-to-end compressive forces.

10. A tank construction method as set forth in claim 9, wherein said means for reducing said resistance to movement includes plastic sheet means.

* * * * *